United States Patent [19]

Hashimoto et al.

[11] 4,382,706

[45] May 10, 1983

[54] MECHANICAL PENCIL

[75] Inventors: Yasuyuki Hashimoto, Nishinomiya; Kazuo Shimizu, Neyagawa, both of Japan

[73] Assignee: Ancos Co., Ltd., Osaka, Japan

[21] Appl. No.: 260,486

[22] Filed: May 4, 1981

[30] Foreign Application Priority Data

May 7, 1980 [JP] Japan ..... 55-61475[U]
Aug. 6, 1980 [JP] Japan ..... 55-107098

[51] Int. Cl.[3] ..... B43K 21/22
[52] U.S. Cl. ..... 401/67; 401/65
[58] Field of Search ..... 401/68, 65–67, 401/74, 75, 85, 82, 89, 92, 93

[56] References Cited

U.S. PATENT DOCUMENTS 3,728,033 4/1973 Seta et al. ..... 401/67
3,813,175 5/1974 Katz ..... 401/65
4,106,874 8/1978 Torii ..... 401/67
4,149,813 4/1979 Katz ..... 401/67 X
4,218,153 8/1980 Hashimoto ..... 401/67
4,269,524 5/1981 Hashimoto et al. ..... 401/65

*Primary Examiner*—Stephen C. Pellegrino
*Attorney, Agent, or Firm*—Sughrue, Mion, Zinn, Macpeak & Seas

[57] ABSTRACT

A mechanical pencil including a main body divided into first and second members which are rotatable relative to one another. An inner mechanism is provided, primarily in the first member of the body, including a chuck for gripping leads, a chuck tightening member for tightening the chuck disposed around the chuck, a chuck tightening member receiver, and a lead case coupled at a front end portion to the chuck. In a preferred embodiment, a push member is coupled at a front end to the lead case while a spring biases the inner mechanism rearwardly. A mechanism is provided for converting the relative rotation of the first and second members to axial movement of the inner mechanism between retracted and writing positions.

7 Claims, 7 Drawing Figures

MECHANICAL PENCIL

BACKGROUND OF THE INVENTION

The present invention relates to a mechanical pencil in which an inner mechanism is movable between a writing position and a retracted position by rotation of the axial pencil body, wherein in the writing position, a lead is supplied from a front end of the pencil by depression of a rear end member thereof.

There have heretofore been provided a so-called "double-push" type mechanical pencil in which an inner mechanism is movable between a writing position and a retracted position by a long stroke depression of the axial pencil body and at the writing position a lead is supplied from the front end of the pencil by a short stroke depression. The double-push type mechanical pencil is very convenient since the sharp front end of the mechanical pencil is retracted into the mechanical pencil to thereby prevent the user's pocket from being torn the user inadvertently being stabbed with the sharp front end. However, such a mechanical pencil has the following disadvantages.

A rather strong spring is needed for moving the inner mechanism. Also, to advance the mechanism, a long stroke is needed against a force of a chuck spring used for clamping the lead in addition to the force of the above-described strong spring. Therefore, the operator must use a rather strong force.

In order to remedy this defect, the force of the spring applied to the inner mechanism movement can be reduced. However, in this case it is difficult to distinguish a strong long stroke push from a weak short push. Such a mechanical pencil is inconvenient since the inner mechanism can readily be erroneously retracted into the mechanical pencil body.

In another aspect of such a prior art mechanical pencil, a cam mechanism is frequently used for moving the inner mechanism. A cam sleeve constituting a part of the cam mechanism must have a rather large diameter so that the diameter of the outer pencil body is increased. This is not desirable in view of aesthetic considerations. Furthermore, in the prior art mechanical pencil, a push rod must be long enough to advance the inner mechanism by a long stroke and further to supply a lead by a short stroke. In addition, in the long stroke operation, an idle distance for operating the cam mechanism is needed. For these reasons, the required stroke length is longer than desirable. This leads to an increase of the push rod length. Due to this, the prior art mechanical pencil is also inferior in aesthetic design.

An object of the present invention is thus to provide a novel mechanical pencil, overcoming the above noted defects, and specifically to provide an easy to use mechanical pencil having a superior aesthetic design.

SUMMARY OF THE INVENTION

In accordance with this and other objects of the invention, there is provided a mechanical pencil including a body divided into a first member and a second member with the first member being rotatable relative to the second member. An inner mechanism is provided including a chuck for gripping a lead, a chuck tightening member for tightening the chuck, a chuck tightening member receiver, and a lead case coupled to a rear end portion of the chuck. A push member is coupled to a rear end portion of the lead case and a spring biases the inner mechanism rearwardly. Means is provided for converting relative rotation of the first and second members to axial movement of the inner mechanism between a retracted position and a writing position.

Yet further, the invention can be practiced by a mechanical pencil including a body divided into first and second members with the first member being rotatable relative to the second member. An inner mechanism is provided within the first member including a tip sleeve, a lead retaining member retainer, an inner mouth member, and a tightening member receiver. A chuck for gripping a lead engaged with the chuck tightening member is also provided in this grouping. Means is provided for converting relative rotation of the first and second members to axial movement of the inner mechanism between retracted and writing positions. A lead case is coupled at a front end to the chuck. The inner mechanism, the tightening member, and the chuck cooperate with each other so that, during operation of the converting means when the tightening member is moved through a predetermined longitudinal distance within the inner mechanism, the tightening member and the chuck are engaged with each other. When the chuck is moved away beyond the predetermined longitudinal distance, the chuck is disengaged from the tightening member to thereby release the lead held thereby.

DESCRIPTION OF THE PREFERRED EMBODIMENTS

Figure 1:
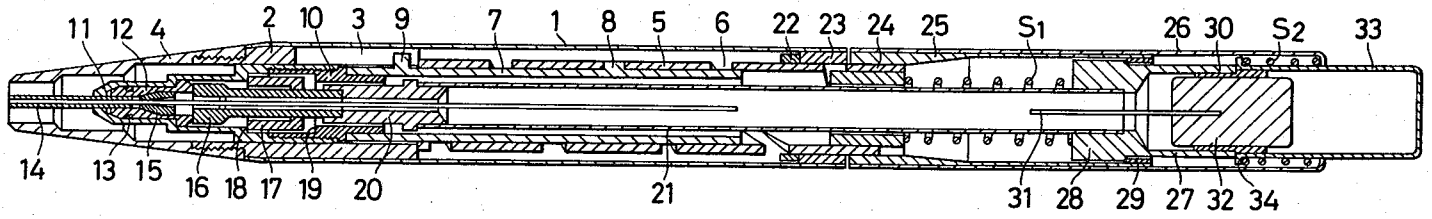
FIG. 1 is a longitudinal cross-sectional view of a mechanical pencil of a first embodiment according to the present invention.

FIG. 1 is a longitudinal cross-sectional view of a first embodiment of a mechanical pencil constructed in accordance with the present invention. The mechanical pencil in FIG. 1 is shown in a non-use or carrying state. Reference numeral 1 denotes a first or front axial body. To a front end of the front axial body 1 along an inner periphery thereof is integrally secured a tubular joint member 2. A guide groove 3 extending in the axial direction is formed in the joint member 2. A threaded portion of the joint member 2 is engaged with an associated threaded portion of a front mouth member 4 thereby coupling the mouth member 4 to the front axial body 1 as shown. A rotational sleeve 5 is disposed in the front axial body 1 and is formed with a single spiral groove 6. A cylindrical member 7 with an outwardly projected part 8 is inserted into the rotational sleeve 5, the part 8 being engaged with the spiral groove 6. A guide projection 9 is formed at an outer end periphery of the cylindrical member 7 and engages with the above-described axial guide groove 3 of the joint member 2. A tightening member receiver 10 is secured to the front end of the cylindrical member 7. A threaded portion of an inner mouth member 11 is engaged with mating threads of the tightening member receiver 10 thereby coupling the inner mouth member 11 to the cylindrical member 7 through the tightening member receiver 10. The front portion of the inner mouth member 11 is retractable into or extendible from an end opening of the mouth member 4.

A slider 12 is received in an interior portion of the inner mouth member 11. An annular retainer 13 made of elastic material is inserted into an annular groove formed in the periphery of the slider 12. The retainer 13 is in light but retaining contact with an inner surface of the inner mouth member 11. The slider 12 is provided with a tip sleeve 14 which is retractable into or extendible from the end opening of the mouth member 11 and from the end opening of the front mouth member 4. On an inner surface of the slider 12 is mounted a lead retaining member 15 made of elastic material such as rubber to thereby grip the lead with a light force.

A lead gripping chuck 16 is disposed behind the slider 12 and is surrounded by a tightening member 17 which is movable through a short distance between a shouldered portion 18 of the inner mouth member 11 and a shouldered portion 19 of the tightening member receiver 10. The chuck 16 is coupled at a rear end to a lead supply guide 20 which is in turn coupled at a rear end thereof to a lead case 21.

A ring 22 is secured to the outer periphery of the rotational sleeve 5 adjacent a rear end of the rotational sleeve 5 and a stop ring 23 is secured to the inner periphery of the front axial body 1 behind the ring 22, whereby the inner mechanism, composed of the rotational sleeve 5, the cylindrical member 7, the tightening member receiver 10, the inner mouth member 11, the slider 12, the chuck 16, the lead case 21 and related components, is prevented from being pulled apart. A ring 24 is integrally secured to an inner end periphery of the rotational sleeve 5. An inner annular spacer 25 is integrally secured to an outer end periphery of the rotational sleeve 5. The inner annular spacer 25 is located behind the stop ring 25 inserted into the front axial body 1 and is in contact with the stop ring 23. A rear axial body 26 is secured to an outer periphery of the spacer 25. Thus, as the rear axial body 26 rotates relative to the front axial body 1, all of the inner spacer 25, the rotational sleeve 5, the ring 22 and the ring 24 are rotated together.

A cylindrical sleeve 27 is coupled to a rear end of the lead case 21. The cylindrical sleeve 27 has a large diameter portion 28 on the front side thereof. A stop ring 29 is secured to a rear end of the inner annular spacer 25 within the interior of the spacer 25. By the abutment of the large diameter portion 28 against the stop ring 29, the cylindrical sleeve 27, the lead case 21, chuck 16 and the like are prevented from further moving rearwardly. Between the ring 24 secured to the rotational sleeve 5 and the large diameter portion 28 of the cylindrical member 27 is disposed a spring $S_1$ to thereby urge the chuck 16, the lead case 21 and the related components rearwardly. In the retracted position shown in FIG. 1, the chuck 16, the lead case 21 and the related components are moved most rearwardly while the large diameter portion 28 of the cylindrical member 27 is in abutment with the stop ring 29. In this condition, the chuck 16 is disengaged and separated from the tightening member 17 and the lead is not grasped by the chuck 16.

An eraser holder 30 in which an eraser 32 having a cleaner pin 31 is held is detachably coupled to a rear end portion of the cylindrical member 27. An inner front periphery of a push cap 33 surrounds an outer periphery of the eraser holder 30 at the rear part of the cylindrical member 27, but the push cap 33 is movable through an opening of the rear end of the rear axial body 26. The push cap 33 is formed with a flange 34 at a front end. Between the flange 34 and an inwardly bent portion of the rear axial body 26 is disposed a spring $S_2$ to bias the push cap 33 forwardly. A washer (not shown) for preventing the flange 34 from dropping out of the rear axial body 26 is provided at a rear portion in the interior of the rear axial body 26 so that when the rear axial body is removed in order to furnish a new supply of leads and for use of the eraser, the push cap 33 is prevented from falling off.

In operation, when the front axial body 1 is grasped in one hand and the rear axial body 26 is rotated with the other hand, the rotational sleeve 5 is rotated together through the inner spacer 25. Since the cylindrical member 7 is engaged at the guide projection 9 with the axial guide groove 3 of the joint member 2, the cylindrical member 7 can move axially but not rotate. Therefore, when the rotational sleeve 5 rotates, the spiral groove 6 pushes the projection 8 of the cylindrical member 7 to thereby advance the cylindrical member 7. When the cylindrical member 7 is advanced, the inner mouth member 11 is also advanced through the tightening member receiver 10. Since the retainer 13 is in a light elastic contact with the mouth member 11, as the mouth member 11 is advanced, the slider 12 is also moved forwardly. At this time, since the chuck 16 is held open, the slider 12 allows the lead to advance through the chuck by action of the lead retainer 15. Then, when the inner mouth member 11 is projected through the opening of the mouth member 4 to the writing position shown in FIG. 2, the cylindrical member 7 is no longer advanced since the guide projection 9 on the cylindrical member 7 abuts against the front end of the guide groove 3. As a result, the rotational sleeve 5 is no longer rotated. Then, the inner mechanism advanced condition is realized.

In the writing position, the tightening member 17 is pushed by the shouldered portion 19 of the tightening member receiver 10 so that the chuck 16 is tightened by the tightening member 17. By coupling the tightening member to the chuck 16, the lead is suitably grasped. In this embodiment shown in FIG. 2, the chuck 16, the lead case 21 and the related components are advanced through a short distance with the spring $S_1$ compressed.

Figure 2:
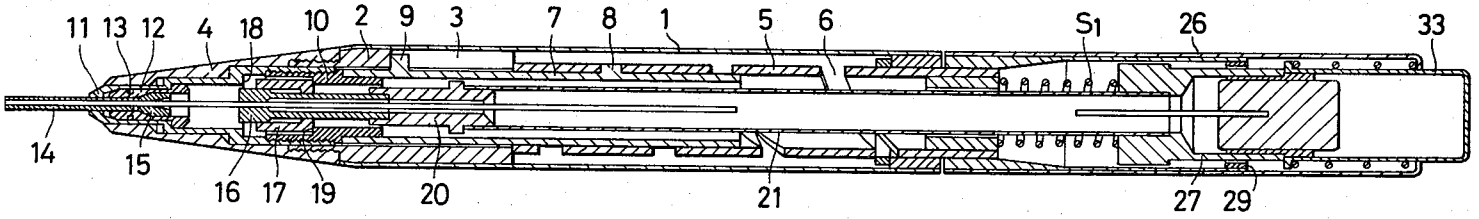
FIGS. 2 and 3 are longitudinal cross-sectional views of the mechanical pencil of FIG. 1 showing different operational conditions.

Then, in the position shown in FIG. 2, as writing is continued, corresponding to the amount of use of the lead, the slider 12 is gradually retracted by the writing pressure with the slider 12 contacting with the paper surface. Writing can be continued without any additional operation until the slider 12 is almost retracted. Since the lead is protected by the slider 12, breakage of the lead is positively prevented.

Figure 3:
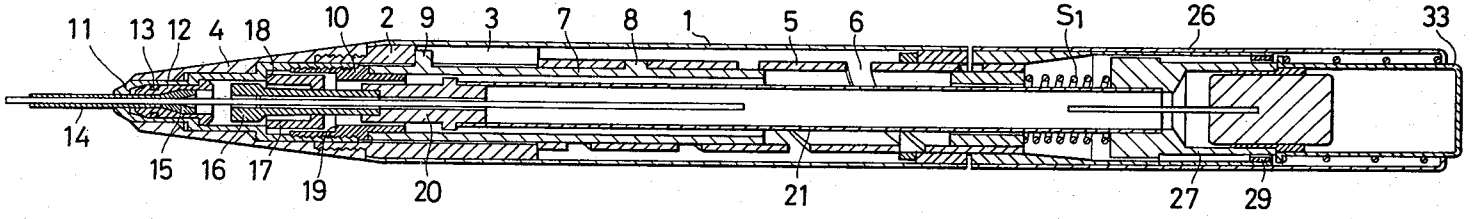

In order to supply a lead from a front end of the slider 12 or in order to advance the retracted slider 12, the push cap 33 is depressed in the condition where the lead is firmly clamped by the engagement between the chuck 16 and the tightening member 17. Namely, when the push cap 33 is depressed, the chuck 16 is advanced through the cylindrical member 27, the lead case 21 and the lead guide 20. However, in case the slider 12 is retracted, the slider 12 is pushed by the advanced chuck 16 so that the slider 12 is advanced until the slider 12 is placed to a forward-most position. Thereafter, upon each depression of the push cap 33, the chuck 16 is advanced in engagement with the tightening member 17. As a result, lead is supplied by a predetermined length from the position of the tightening member 17 shown in FIG. 2 to the position where the tightening member 17 is in abutment with the shouldered portion 18 of the inner mouth member 11 as shown in FIG. 3.

It is preferable that the lead retaining force of the lead retainer 15 be greater than the holding force of the annular retainer 13 for holding the slider 12. With such a construction, by repeatedly pressing on the push cap 33 using short strokes, the slider 12 retracted in the inner mouth member 11 is advanced to the same extent as the lead supply. Accordingly, it is not required to push the slider 12 using the front end of the chuck 16. The anular retainer 13 is not always provided. Also in absence of the annular retainer 13, it is possible to feed lead from the opening of the pipe 14. In this case, the tip end of the mechanical pencil is directed downwardly and then the push cap 33 is depressed so that the chuck 16 is opened and at the same time the slider 12 allows the lead to move through the chuck 16 by action of the retainer 15 while the slider 12 is advanced to the front-most position by its gravitational force.

In order to return the mechanical pencil back to the retracted position when writing is finished, it is only required to rotate the rear axial body 26 in the opposite direction relative to the front axial body 1. When the rear axial body 26 is rotated in the opposite direction, the rotational sleeve 5 is also rotated in the same direction to thereby move the cylindrical member 7 rearwardly. As a result, the inner mouth member 11 is moved rearwardly through the tightening member receiver 10. The inner mouth member allows the slider 12 to move rearwardly, the chuck 16, the lead case 21 and the like are moved rearwardly by the spring $S_1$ until the large diameter portion 28 of the cylindrical member 27 is in abutment with the stop ring 29 to thereby realize the state shown in FIG. 1.

The invention has been described with reference with a first specific preferred embodiment. However, it is apparent that the invention is not limited to this embodiment. For example, in this embodiment the moving mechanism for moving forwardly and rearwardly the tightening member receiver 10, the inner mouth member 11, the tightening member 17 and the like when the rotational sleeve 5 is rotated is of spiral groove type. Instead, another screw moving mechanism or cam mechanism may be used. The location of the mechanism is not limited to the specific location shown. However, in any case a first component is rotatable relative to a second component to thereby move forwardly and rearwardly the tightening member receiver 10, the inner mouth member 11, the tightening member 11 and the like.

The mechanical pencil shown in FIGS. 1–3 is a half-slide type where the slider end is still projected from the opening of the mouth member after writing has continued to the point where the slider is in the rear-most position. It is possible to construct the pencil as a full slide type mechanical pencil. Moreover, it is possible to provide a fixed type mechanical pencil in which the front sleeve is fixed to the inner mouth member. In the specific embodiment described, the spring $S_1$ is provided at the rear part of the body for grasping the lead. This spring may also be provided at the front part of the body. In the embodiment shown, the tightening member 17 is movable between the shouldered portion 18 of the inner mouth member 11 and the shouldered portion 19 of the tightening member receiver 10. However, for the slide type, the tightening member 17 may be fixed. It should be noted that the retainer 13 is required for use when the axial body is rotated to advance the slider 12 while the front end of the mechanical pencil is directed upwardly. Accordingly, when the mechanical pencil is used with the front end directed downwardly the retainer 13 is unnecessary. Various other design modifications are possible.

The invention provides the following advantageous effects.

According to the mechanical pencil of the present invention, when one of the front and rear axial bodies is rotated relative to the other, the inner mechanism composed of the inner mouth member 11, the chuck 16, the tightening member 17, the lead case 21 and related components is advanced to thereby project the inner mouth member 11 through the end opening of the body for writing. In the interior of the tightening member 17 is disposed the chuck 16 and the chuck 16 is coupled to the front end of the lead case 21. The push member is coupled to the rear end of the lead case 21. Accordingly, in writing condition lead is supplied for writing by the depression of push member through the lead case 21, the chuck 16 and the tightening member 17. Since by rotating one of the axial members while supporting the other, the inner mechanism is advanced or retracted between writing and carrying positions, a large force, such as a compression force for compressing a strong spring by the push force is not needed. Therefore, the mechanical pencil is easy to handle even for a user having a weak hand. Furthermore, since no cam sleeve or the like is required, the diameter of the outer axial body may be decreased, and since the projected part from the body can be reduced in length, the aesthetic appearance of the pencil of the invention is superior to that of a prior art double push mechanical pencil. Since the lead is not grasped by the chuck 16 in the retracted condition, breakage of the lead due to accidental shock is prevented.

Further, the operation of moving the inner mechanism between the writing and retracted positions is achieved by rotation of the body member, and the lead supply operation is achieved by a simple pushing movement. These operations are clearly independent of one another. In the conventional double push-type mechanical pencil with the slider, since the inner mechanism thereof is rapidly retracted when the mechanical pencil is brought into the retracted state, a shock caused by the rapid movement of the inner mechanism may cause the slider to be slid rearwardly relative to the clamped lead against the retaining force of the lead retainer resulting in extra lead supply from the slider opening. Such a disadvantage can be overcome according to the present invention due to the rotational retraction operation. Since a rotational operation is needed only in the start and the final stage of the writing operation, frequent rotational operations are not required. The mechanical pencil of the invention is simple and therefore, its production cost is low.

Another embodiment of a mechanical pencil of the present invention will now be described with reference to FIGS. 4 to 7. Reference numeral 101 denotes an axial sleeve. A joint member 102 is coupled to an inner surface end portion of the axial sleeve 101 and is coupled to a front mouth member 103. The joint member 102 is threadedly engaged with the mouth member 103. A ring 104 is inserted into the inner periphery of the axial sleeve 101 with its front end contacting with a rear end of the joint member 102. A cylindrical member 105 is further inserted into the axial member 101 with its front end contacting with a rear end of the ring 104. An axially extending long inner sleeve 106 is secured in a space defined by the outer axial sleeve 101 and the cylindrical member 105 so that the cylindrical member 105 and the inner sleeve 106 can rotate together. A rear portion of the inner sleeve 106 projects from the rear opening of the axial sleeve 101 and is surrounded by a cap 107 with the rear end of the axial sleeve 101 abutting against the front end of the cap 107. The cap 107 is detachable from the rear portion of the inner sleeve 106 but when engaged therewith the cap 107 is rotatable together with the inner sleeve 106. The cap 107 is provided with a clip 108. The mouth member 103, the axial sleeve 101 and the cap 107 constitute the body of the mechanical pencil.

A rotational sleeve 109 is inserted into the interior of the cylindrical member 105 so that the rotational sleeve 109 can rotate together with the cylindrical member 105. A single spiral groove 110 is formed in the rotational sleeve 109. A long guide sleeve 111 is secured at a front portion to the joint member 102 and is supported at the rear side to the inner periphery of the rotational sleeve 109. An axial slot 112 is formed in an end portion of the guide sleeve 111. A radially projected portion 113 is formed at a rear end portion of the guide sleeve 111. A ring 114 is secured around the outer end periphery of the guide sleeve 111 in front of the projected portion 113. The ring 114 contacts at the front end thereof the rear end of the rotational sleeve 109. A slidable sleeve 115 is inserted into the interior of the guide sleeve 111 and is provided at a rear end portion with a projection 116 which is engaged past the slot 112 of the guide sleeve 111 with the spiral groove 110 of the rotational sleeve 109. A tightening member receiver 117 is mounted on a front end of the slidable sleeve 115. The tightening member receiver 117 is threadedly engaged at a front end portion with an inner mouth member 118.

A slider 119 is disposed in the interior of the inner mouth member 118. An annular recess is formed in an outer periphery of the slider 119 and is provided with a retainer 120 made of elastic material. The retainer 120 is in light but fitting contact with the inner surface of inner mouth member 118. A tip sleeve 121 is mounted on a front end of the slider 119 so that the tip sleeve 121 is projectable through a front opening of the mouth member 103. In the slider 119 is disposed retainer 122 made of an elastic material such as a rubber so as to lightly hold a lead therein. The retaining force of the retainer 122 is smaller than that of the retainer 120 provided around the outer periphery of the slider 119.

On the rear side of the slider 119 is disposed a chuck 123. Around the chuck 123 is located a chuck tightening member 124. The tightening member 124 is movable between a shouldered portion 125 formed in an inner periphery of the inner mouth member 118 and a shouldered portion 126 formed in an inner periphery of the tightening member receiver 117. A lead guide 127 is coupled to a rear end of the chuck 123. The lead guide 127 is coupled at a rear end to a lead case 128.

A stop ring 129 is secured to an outer end of the lead case 128. A shouldered portion 130 is formed at a front end portion of the stop ring 129. Another stop ring 131 is secured to a rear end of the inner sleeve 106 and is coupled thereto. The stop ring 129 mounted on the lead case 128 is movable in the front side of the stop ring 131 mounted on the inner sleeve 106. The stop ring 129 is prevented from moving further rearwardly when the shouldered portion 130 of the stop ring 129 is in abutment with the front end of the stop ring 131 to thereby prevent the lead case 128 and related components from dropping out. A receiver ring 132 is secured to the guide sleeve 111. A spring S is disposed between the receiver ring 132 and the stop ring 129 mounted on the lead case 128 to bias the chuck 123, the lead guide 127 and the lead case 128 rearwardly through the stop ring 129. In the retracted position shown in FIG. 4, by the action of the spring S, the chuck 123, the lead case 128 and related components are retracted to a rearward-most position where the shouldered portion 130 formed in the stop ring 129 mounted on the lead case 128 is in abutment with the front end of the stop ring 131 mounted on the inner sleeve 106. At this time, the chuck 123 is disengaged from the chuck tightening member 124 so that the lead is also released. At the same time, the slider 119 is moved to a rearward-most position with the inner mouth member 118 while the rear end of the slider 119 is in abutment with the front end of the chuck 123 so that the front end of the tip sleeve 121 is positioned at a slightly retracted position from the front opening of the mouth member 103.

An eraser holder 133 is detachably mounted on a rear half inner periphery of the stop ring 129 and an eraser 135 having a cleaner pin 134 is inserted into the holder 133.

The operation of the thus constructed mechanical pencil will now be described in reference to FIG. 4. When the axial sleeve 101 is rotated with one hand while the cap 107 is held in the other hand, the rotational sleeve 109 is rotated together therewith through the inner sleeve 106 and the cylindrical member 105. Since the slide sleeve 115 is axially movable but not rotatable with the projection 116 engaged with the slit 112 of the guide sleeve 111, when the rotational sleeve 109 is rotated, the projection 116 is pushed by the spiral groove 110 to thereby advance the slide sleeve 115. When the slide sleeve 115 is advanced, the inner mouth member 118 is also advanced through the tightening member receiver 117. By the contact of the retainer 120 against the inner mouth member 118, the slider 119 is also advanced. Since at this time the chuck 123 is still open, the slider 119 pushes the lead to be drawn out of the chuck 123 through the retainer 122. Then, when the tip sleeve 121 is projected from the opening of the mouth member 103 as shown in FIG. 5, forward-movement of slide sleeve 115 is prevented. This state is suitable for writing. In the writing condition, the tightening member 124 is pushed by the shouldered portion 126 of the tightening member receiver 117 to thereby grip the chuck 123 with the tightening member 124, that is, the chuck 123 is engaged with the chuck tightening member 124 so that the lead is positively gripped.

Figures 4, 5, 6, 7:
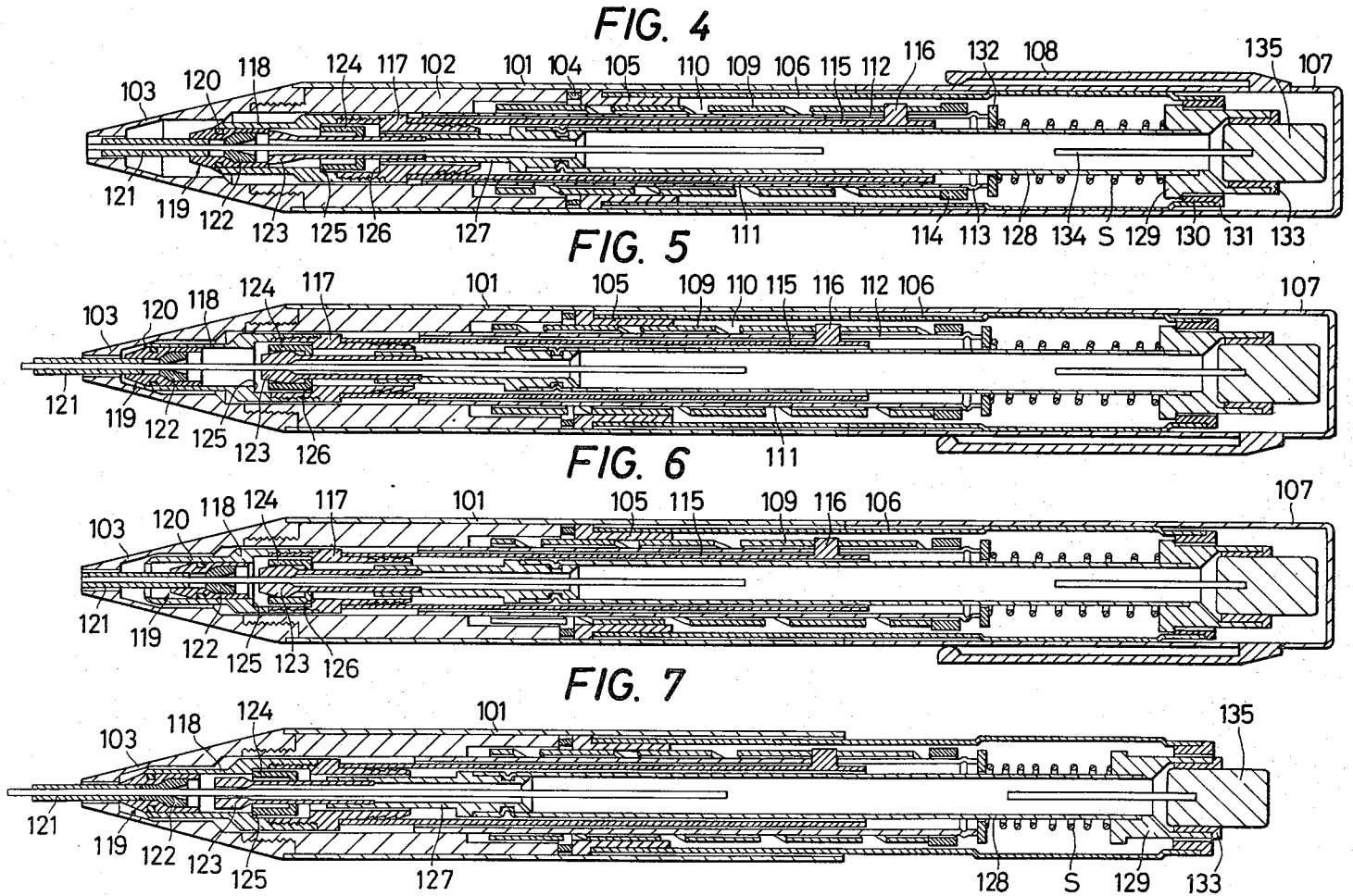
FIG. 4 is a longitudinal cross-sectional view of a mechanical pencil of a second embodiment according to the present invention.
FIGS. 5–7 are longitudinal cross-sectional views of the mechanical pencil of FIG. 4 showing various operational conditions thereof.

When writing is continued in the position shown in FIG. 5, as the lead projected from the tip sleeve 121 is used up, corresponding to the use of the lead, the slider 119 is pushed by the paper surface and retracted rearwardly. Thus, without any additional operation writing can be continued until the slider 119 is fully retracted. Since the lead is protected by the slider 119, leakage of the lead is prevented. The state where the slider 119 is fully retracted due to writing is shown in FIG. 6.

In order to return the mechanical pencil from the position shown in FIG. 6 back to the writing condition shown in FIG. 5, after rotating the cap 107 in the opposite direction, the cap 107 is rotated in the original direction one more time. When the cap 107 is rotated in the opposite direction, the rotational sleeve 109 is rotated in the opposite direction through the inner sleeve 106 and the cylindrical member 105 and the slide sleeve 115 is moved rearwardly through the projection 116 to thereby move the inner mouth member 118 and the tightening member receiver 117 rearwardly. When the inner mouth member 118 is moved rearwardly, by action of retainer 120 the slider 119 is moved rearwardly together therewith. Until the tightening member 124 is in abutment with the shouldered portion 125 of the inner mouth member 118, the tightening member 124 and chuck 123 are engaged with each other to thereby grip the lead and the lead is not moved rearwardly. Further, the retaining force of the lead retainer 122 at the inner side of the slider 119 is smaller than the retaining force of the retainer 120 at the outer periphery of the slider 119 for retaining the slider 119. Accordingly, since even if the slider 119 is fully retracted into the inner mouth member 118, the inner mouth member is moved by a predetermined length rearwardly with the slider 119 maintained at that location therein, lead in a predetermined length is supplied from the opening of the tip sleeve 121 against the force of the lead retaining member 122 by the rearward movement of the inner mouth member 118. Then after the shouldered portion 125 of the inner mouth member 118 is in abutment with the tightening member 124, the tightening member 124 is also moved rearwardly to thereby disengage the chuck 123 therefrom and to thereby release the lead therefrom. Accordingly, the lead is held by the lead retainer 122 so that the slider 119 allows the lead to move rearwardly. After the rear end of the slider 119 is in abutment with the front end of the chuck 123 to stop the slider 119, the inner mouth member 118 is moved rearwardly against the force of the retainer 120 and returned back to the state shown in FIG. 4. At this time, if the cap 107 is rotated in the original direction, the state shown in FIG. 5 can be obtained in the same manner. Thus, lead in a predetermined length is supplied from the tip end of the tip sleeve 121.

In order to return the mechanical pencil back to the retracted position after completion of writing, the cap 107 need only be rotated in the opposite direction. The operation for the retracted position has been described wherein, in the retracted position, lead in a predetermined length is always projected from the tip sleeve 121 as described above. In case excessive lead is projected from the mouth member 103 in the retracted position, the lead can be pushed into the pencil body since the lead is not grasped by the chuck 123.

In order to provide a new lead at the front end of the tip sleeve 121, first the cap 107 is rotated to thereby advance the inner mechanism. Next, the cap 107 is removed as shown in FIG. 7, and the eraser 135 is depressed with the front end of the mechanical pencil directed downwardly. As a result, the chuck 123 is advanced through the eraser holder 133, the stop ring 129, the lead case 128 and the lead guide 127. When the tightening member 124 advanced together with the chuck 123 in engagement therewith is disengaged from the chuck 123 by the abutment against the shouldered portion 125 of the inner mouth member 118 to thereby open the chuck 123, lead from the lead case 128 is dropped by gravitational force until the end of the lead contacts against the lead retainer 122. At this time, depression of the eraser 135 is released. Then, the depression operations are repeated so that the lead is advanced against the force of the lead retaining member 122 by the distance through which the chuck 123 is moved forwardly in engagement with the tightening member 124. The lead reaches the front end of the tip sleeve 121. This type of operation per se is well known in the art.

The second embodiment of the present invention has been explained with reference to the drawings. However, the invention is not limited to this specific embodiment. For example, in this embodiment, the cap 107 is relatively long and is rotated with ease although, in the same manner as in the first embodiment, the pencil body can be divided into front and rear axial members each rotatable relative to the other and the size of the cap 107 may be small so as to cover the rear opening of the lead case 128 or the eraser 135 mounted on the rear portion thereof. In the specific embodiment described with reference to FIGS. 4 to 7, a spiral groove is used for moving the inner mechanism composed of the inner mouth member 118, tightening member receiver 124 and related components when the rotational sleeve 109 is rotated. Instead, another screw moving mechanism or cam mechanism may be used. The location of the mechanism is no limited to the specific location shown. However, in any case, a first member is rotatable relative to a second member to thereby move forwardly and rearwardly the inner mechanism composed of the mouth member 118, the tightening member 124 and related components. Many other modifications are possible as described in the first embodiment.

With the second embodiment, the following advantageous effects are obtained.

When one of the body members is rotated relative to the other, the inner mechanism, encased in the body member and composed of the tip sleeve 121, the lead retainer 122, inner mouth member 118, the tightening member receiver 117 and related components is advanced until the tip sleeve 121 is projected from the opening of the body member for writing. In this state, the lead is positively gripped by the engagement between the chuck 123 and the tightening member 124 and writing can be carried out in this state. In order to supply lead at the front end opening of the tip sleeve 121, one of the body members is rotated relative to the other and immediately thereafter the one member is rotated to the original position. When one of the body members is rotated in the reverse direction, the inner mechanism is moved rearwardly and the tightening member 124, movable through a predetermined distance in the inner mechanism, is moved together with the chuck 123 through the same distance in engagement with the chuck 123. Lead in a length corresponding to this distance is supplied from the front end of the tip sleeve 121. Then, when one of the body members is rotated in the original direction, the inner mechanism and related components are advanced for writing. At this time, lead in the predetermined length is provided.

As mentioned above, in order to return the mechanical pencil to the retracted position, one of the body members is rotated in the opposite direction moving the tip sleeve 121 and related components rearwardly to the retracted state.

The lead supply length obtained by the one operation depends on the movement distance of the tightening member 124. This distance can be easily controlled in design.

The mechanical pencil according to the second embodiment of the invention is suitable as a mate for a rotational type ball point pen which is considered as a higher class pen than a push type pen. Further, according to the invention, the push rod is not visible from the exterior of the pen. This feature provides a superior aesthetic design. In accordance with the invention, the eraser 135 and the like are covered by the cap 107 thus enhancing the appearance of the pencil making the pencil suitable for set selling with a rotational type ball point pen.

Also, in supplying a new lead from the lead case to the tip end of the tip pipe or in pushing an old lead by the new lead, it is preferable to depress the rear end of the lead case without the cap. This operation is very simple and useful.

What is claimed is:

1. A mechanical pencil comprising hollow body means including first and second members interconnected for rotation relative to each other with said first and second members having axial openings at opposite ends of said body means, an axially movable inner mechanism including a lead case, a chuck secured to one end of said lead case adapted to grip a piece of lead, a chuck tightening member movably carried by said chuck for causing said chuck to grip and release a piece of lead and a push member coupled to said lead case and extending outwardly of said opening in said second member, and connecting means for converting relative rotation of said first and second members to axial movement of said inner mechanism to axially move said inner mechanism between a retracted position and a writing position extending through said opening in said first member, said inner mechanism being further axially movable by actuation of said push member when said inner mechanism is in said writing position to incrementally feed a supply of lead.

2. A mechanical pencil as set forth in claim 1, wherein said connecting means includes a sleeve having a spiral groove rotatable with said second member, an axially extending groove on the interior surface of said first member and a cylindrical member having projections located in said spiral groove and said axial groove for moving said cylindrical member axially upon rotation of said second member relative to said first member.

3. A mechanical pencil as set forth in claim 2, further comprising a tightening member receiver and an inner mouth member secured to one end of said cylindrical member, said tightening member receiver adapted to engage said chuck tightening member and an inner mouth member adapted to be advanced and retracted through said axial opening in said first member.

4. A mechanical pencial as set forth in claim 3, further comprising a slider member axially movable within said inner mouth member including first retaining means for frictionally engaging a lead for movement with said slider member and second retaining means for frictionally engaging said slider member with said inner mouth member.

5. A mechanical pencil as set forth in claim 1, further comprising spring means disposed between said second member and said push member for normally biasing said inner mechanism toward said axial opening in said second member.

6. A mechanical pencil as set forth in claim 3, further comprising a slider member fixed to said inner mouth member.

7. A mechanical pencil comprising hollow body means including first and second members interconnected for rotation relative to each other with said first and second members having axial openings at opposite ends of said body means, slider means having lead gripping means disposed in said first member adjacent said opening in said first member, a lead case disposed in said body means for axial movement relative thereto, a chuck secured to one end of said lead case adapted to grip a piece of lead, a chuck tightening member movably carried by said chuck for causing said chuck to grip and release a piece of lead, a push member coupled to said lead case and extending outwardly of said opening in said second member and connecting means for converting relative rotation of said first and second members to axial movement of said slider means to axially move said slider means between a retracted position and a writing position extending through said opening in said first member, said lead case and chuck being axially movable by actuation of said push member when said slider means is in said writing position to incrementally feed a supply of lead.

* * * * *